United States Patent [19]

Grant

[11] Patent Number: 4,972,615

[45] Date of Patent: Nov. 27, 1990

[54] BOOK INDEX TABS

[76] Inventor: Michael D. Grant, 9141 Five Harbors, Huntington Beach, Calif. 92646

[21] Appl. No.: 935,397

[22] Filed: Nov. 26, 1986

[51] Int. Cl.[5] ..... G09F 23/10

[52] U.S. Cl. ..... 40/641; 40/638

[58] Field of Search ..... 40/2 R, 299, 638, 641, 40/359, 360; 283/109, 41

[56] References Cited

U.S. PATENT DOCUMENTS

| | | | |
|---|---|---|---|
| 2,007,003 | 7/1935 | Rosen | 40/2 R |
| 2,893,144 | 7/1959 | Cunningham | 40/2 R |
| 3,473,827 | 10/1969 | Leadbetter | 40/2 R |
| 3,535,804 | 10/1970 | Cunningham | 40/2 R |
| 3,795,982 | 3/1974 | Cunningham . | |
| 3,854,229 | 12/1974 | Morgan | 283/109 |
| 4,061,808 | 12/1977 | Sato | 40/2 R |
| 4,204,639 | 5/1980 | Barber et al. | 40/2 R |

*Primary Examiner*—Kenneth J. Dorner
*Assistant Examiner*—J. Hakomaker
*Attorney, Agent, or Firm*—Christie, Parker & Hale

[57] ABSTRACT

A sheet of book index tabs has a backing with a release coating and a plurality of index tabs on the backing sheet separated from each other by die-cut lines. Each index tab has a transparent film layer and transparent pressure sensitive adhesive which is temporarily attached to the release coating. Each tab has a centrally located, substantially opaque band of ink extending across the tab. Stripes of dark ink are printed along each edge of the band with each stripe being an equal distance from the adjacent edge of the tab. A score line on the bottom of the backing is centered opposite the center of the band of ink to facilitate creasing of the backing and index tab. The tab takes a permanent set along the crease and separates from the release coating along the set to facilitate peeling from the backing. Upon folding the index tab along the crease, the dark stripes are superimposed for placement along the edge of a document page as an aid to alignment. Preprinted indicia are included on each side of the center line of the inked band so that after placement on a page, the indicia may be read from either face of the index tab.

7 Claims, 3 Drawing Sheets

BOOK INDEX TABS

FIELD OF THE INVENTION

This invention concerns sheets of index tabs for adhesion on the edges of documents.

BACKGROUND

It is often desirable to index documents so that parts can be found quickly or easily. Examples include dictionaries or directories where one wishes to find a particular letter, Bibles where it is desirable to easily find various books, cook books, account books, photo albums, travel guides and the like.

For many years it has been common to provide such books with tapering notches on the edges of the pages to expose letters, names of the books of the Bible or other indicia. Such notches are costly to make and are infeasible to add to books a person already has. Such notches are also unidirectional. The indicia in the notches may be seen from only the front of the book, for example, and cannot be seen from the back. Some particularly thick books such as unabridged dictionaries may have some of the notches facing the front and some facing the back so that when the book is open in the middle, the letters in the notches are all visible. This means, of course, that when the book is open any place but the middle, at least some of the indicia in the notches are hidden.

It can therefore be desirable to provide adhesive tabs that can be applied to books extending beyond the edges of the pages so that indicia can be seen from both sides.

A variety of tabs have been proposed. Some are in the form of Y-shaped strips where the two arms of the Y can be glued to opposite faces of a book page with the leg of the Y extending beyond the edge. These tend to be somewhat costly and are often thick so that they add substantial bulk along the edge of the book. It is also difficult to make these with pressure sensitive adhesive since the parts may inadvertently stick to each other. The usual tabs of this type have water activiated glues.

Another type of tab has a pressure sensitive adhesive along part of one face to adhere to a page with an unglued edge of the tab extending beyond the edge of the page. The front face of such a tab can be preprinted but the back adjacent the backing sheet cannot be readily printed. Thus, the tab has one of the shortcomings of the index notches. A significant disadvantage of this type of index tab is the difficulty in aligning the edge of the adhesive with the edge of the page. If the adhesive does not come to the edge of the page, a bothersome gap is left. Worse, if the adhesive extends beyond the edge of the page, it collects dirt and lint, and rapidly becomes quite unsightly.

Still another type of book index tab comprises a transparent film with pressure sensitive adhesive on its lower face. A pair of strips of paper bearing indicia such as books of the Bible are adhered to the adhesive so that the indicia can be seen through the transparent film. The two strips of paper are parallel and centered on the index tab with a gap between the two strips. This assembly is mounted on a backing sheet with a release coating. When the tab is used, it is peeled from the backing and the edge of one of the pieces of paper is abutted against the edge of the page to which the tab is secured. The tab is then folded along the gap between the two strips of paper and the other half of the tab adhered to the opposite face of the page. Such tabs are costly to make because of the extra strips of paper between the label stock and the backing.

Some of these types of tabs generally suitable for the purpose are undesirable since they are unattractive or opaque so as to obscure text when the page of the book has a narrow margin.

Index tabs as provided in practice of this invention are made from stock of the sort used for pressure sensitive labels and the like. Such stock is readily commercially available in a broad variety of forms from a number of vendors. One difficulty with pressure sensitive labels is that it is sometimes hard to peel the self-adhesive label from the backing sheet. It can sometimes be frustrating to start the peeling since the label and backing are virtually uniformly flexible and it is difficult to get a fingernail or the like in the narrow interface between the label and the backing. Starting peeling is particularly difficult when the edges of labels abut each other with only a die-cut line with essentially no space between adjacent labels.

A variety of techniques have been used to alleviate this problem. For example, matrix cut labels are sometimes used where the matrix surrounding individual labels is removed to leave labels as isolated islands on the backing. When such labels are slightly stiffer than the backing, peeling can be initiated by bending. This is not easily accomplished when the label is itself quite thin and flexible.

In some cases the backing sheet has been weakened along diagonally extending lines by deeply scoring the backing sheet or chemically attacking the backing sheet, so that upon bending, the backing sheet breaks to permit easy peeling from the overlying label. Such score lines intentionally damage the backing to a degree that causes it to break upon bending or creasing. Such breakage lines bear no relation to the indicia printed on the label.

Thus, it is desirable to provide index tabs for books or other documents which are quite thin to avoid adding excess bulk to the edges of book pages, can be read from both faces, do not obscure text of the book, can be easily aligned with the edges of the pages to give a neat appearance, can be readily removed from the backing sheets on which the tabs are supplied, can be easily applied to books one already possesses, and are economical to make and sell.

BRIEF SUMMARY OF THE INVENTION

There is, therefore, provided in practice of this invention according to a presently preferred embodiment a sheet of a plurality of book index tabs on a paper backing sheet having a release coating on its upper face. The backing sheet has a straight, shallow, round bottomed score line on its lower face to facilitate folding of the backing sheet towards its lower face without breaking the backing sheet. The index tabs are generally rectangular and separated from each other by a die-cut line so that individual tabs can be separately lifted from the backing. Each index tab comprises a transparent film layer and a transparent pressure sensitive adhesive adjacent the release coating. The transparent film layer is printed with a band of opaque ink having straight side edges parallel to the score line on the lower face of the backing sheet, with the edges spaced equal distances from the score line so that upon folding the backing sheet and index tabs along such a score line, the edges of the band of ink are substantially superimposed. The film layer is sufficiently plastic to take a set upon creasing the backing sheet and index tabs along the score line. This causes the film layer and adhesive to separate from the backing sheet along the center of the band of ink upon flattening of the backing sheet after creasing. The resultant gap 24 permits the index tab to be readily removed from the backing. The contrasting edges of the ink on the index tab facilitate alignment of the tab with the edge of the page to provide a very neat appearance. If desired one can add stripes of dark ink along each edge of the band of ink to enhance contrast and make alignment easy.

The index tab has one transparent margin adhered to one face of the page. The tab is then folded along the crease produced by creasing along the score line on the backing sheet, and the opposite transparent edge margin is adhered to the opposite face of the page to complete installation of the tab.

DRAWINGS

These and other features and advantages of the present invention will be appreciated as the same becomes better understood by reference to the following detailed description when considered in connection with the accompanying drawings wherein.

DESCRIPTION

Figure 1:
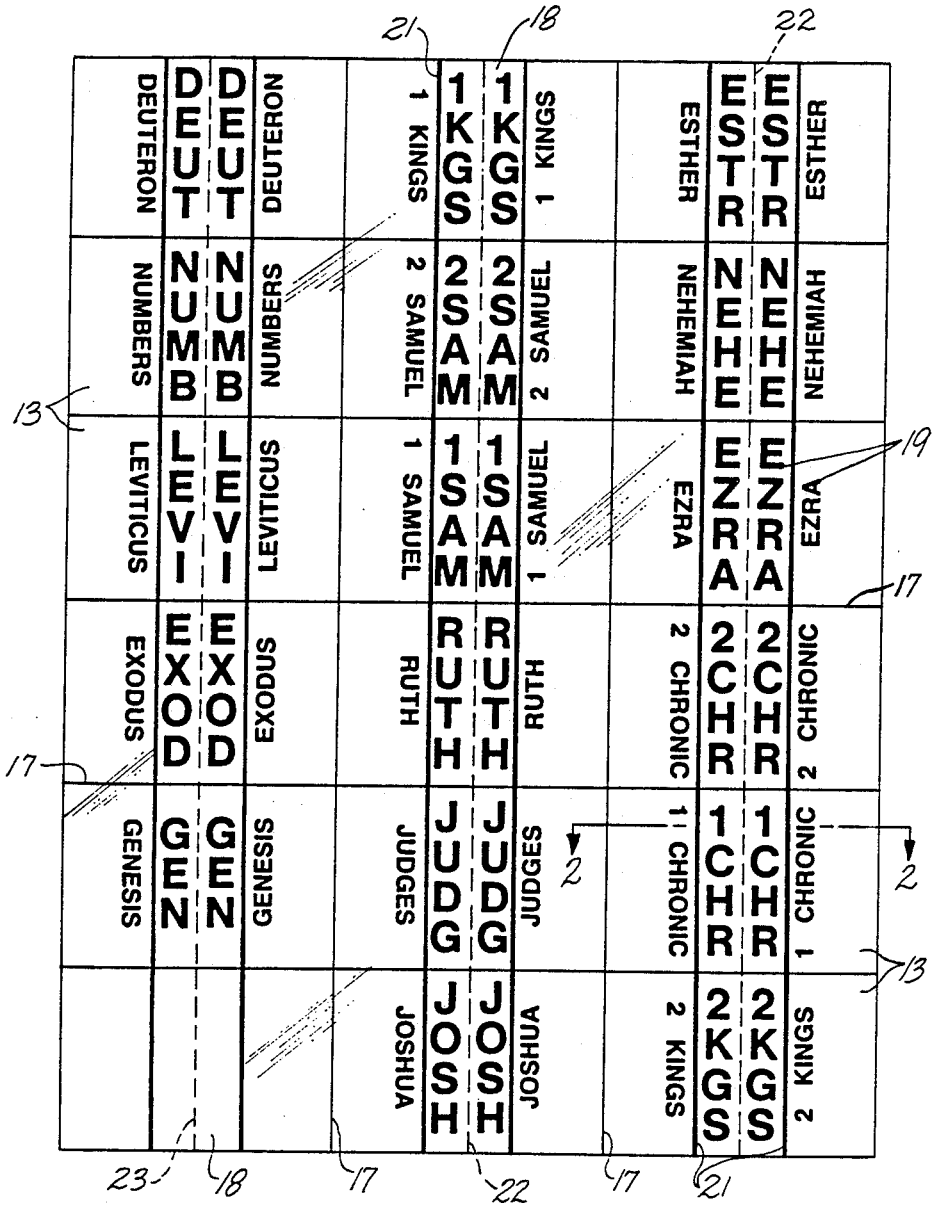
FIG. 1 is a face view of a sheet of book index tabs constructed according to principles of this invention.

A sheet of three columns and six rows of index tabs is seen from the upper face in FIG. 1. In this embodiment the index tabs bear indicia having the names of books of the Bible. Any of a broad variety of other indicia, such as letters of the alphabet, numbers or categories of subject matter for particular applications of the book index tabs may be used.

Figure 2:
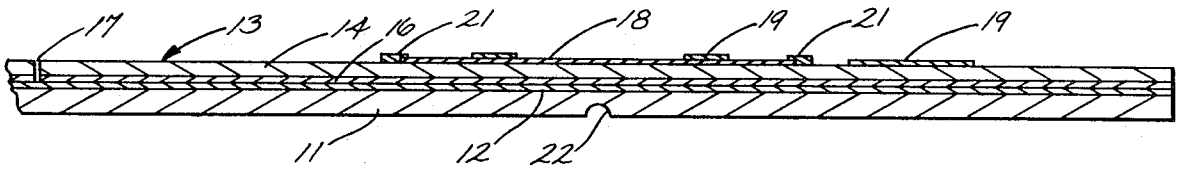
FIG. 2 is a semi-schematic transverse cross section through such an index tab at line 2—2 of FIG. 1.

FIG. 2 is a transverse cross section through the sheet of index tabs at the line 2—2 in FIG. 1. This drawing is semi-schematic since the thicknesses of the layers are not drawn to scale, but are greatly exaggerated for purposes of illustration. For example, a layer of ink is drawn onto the surface of the index tab with visible thickness. In reality such a layer is at most a few microns thick.

The sheet of index tabs comprises a backing sheet 11 sometimes referred to in the art as a release liner. A paper backing having a total thickness of about 6.5 mils is preferred. The paper backing includes a release coating 12 which is conventionally a smoothly calendared silicone. In the illustrated embodiment 18 rectangular index tabs 13 are arrayed on the upper face of the backing, like face cut labels. In an exemplary embodiment each label is about one inch by 1.5 inch.

The label stock for each index tab comprises a transparent film layer 14 with transparent pressure sensitive adhesive layer 16 on the lower face adjacent to the release coating. The adhesive is sufficiently adherent to the release coating to stay in place, but to be peeled from the release without damaging the adhesive. The adhesive also adheres securely to paper. Typical materials for the film layer include cellulose acetate and polyesters such as polyethylene terephthalate. The latter is preferred for its stiffness, strength and long life without changing the book on which it is used. Exemplary thickness is from about 3 to 3.5 mils. The film should be sufficiently plastic to take a permanent set upon creasing the index tab and backing toward the backing.

Individual index tabs are separated from each other by a die-cut line 17. The die-cut extends through the film and adhesive so as to leave no halo of adhesive. With properly adjusted die-cutting equipment the die-cut line can extend through the adhesive with little, if any, indentation in the backing.

A band of reasonably opaque ink 18 is printed from edge to edge across the center of each of the index tabs. The ink used in the band is sufficiently flexible and adherent to withstand creasing of the film layer. Conventional offset or letter press printing may be used as desired. Indicia 19 such as the names of the books of the Bible are printed on both sides of the center of the band of ink. If desired, indicia may be printed on the film layer 14 beyond the edge of the band of ink. Indicia are printed in both locations in the illustrated embodiment. If desired, all indicia may be deleted from the label, leaving the band of ink bare for addition of writing by the user of the index tab.

The edges of the band of ink 18 are parallel to side edges of an index tab and equidistant from the opposite edges. In an exemplary embodiment the band of ink is one-half inch wide and the transparent margin between an edge of the band and the adjacent edge of the index tab is about one-half inch. In a preferred embodiment a stripe of dark (e.g., black) ink 21 is printed along each edge of the band of ink. In an embodiment where the band of ink is itself dark it may be appropriate to delete the edge stripes. Preferably the edge stripes are printed so that at least a portion can be seen through the transparent film and adhesive from the lower face of the index tab. The dark stripes or dark band of ink in such an embodiment provide a contrast to white or light colored pages of a document to aid in alignment of the index tab on the page.

In the illustrated embodiment three shallow score lines 22 are formed in the lower face of the paper backing layer 11 beneath the three columns of index tabs. Such a score line has a rounded bottom and indents the paper backing sufficiently less than the thickness of the backing that it does not break through upon creasing of the index tab and backing sheet along the score line toward the lower face of the backing sheet. The backing sheet may buckle along the score line upon creasing, but it does not break into separate pieces.

Such a score line is symmetrically located between the side edges of the column of index tabs and symmetrically located between the edges of the ink band 18 or edge stripes 21. The score line forms a locus along which the backing sheet and index tabs can be easily creased to preform the tabs for application to the edge of a page of a document.

When it is desired to apply an index tab to the edge of a page, the first step is to sharply crease the backing and index tab along the score line. Since the index tab is plastic, it deforms and takes a permanent set, i.e., it is no longer flat but has a bend along the locus of the score line. Because of the symmetrical location of the score line relative to the edges of the tabs, the set is along the center line of the inked band across the center of the index tab.

Figure 3:
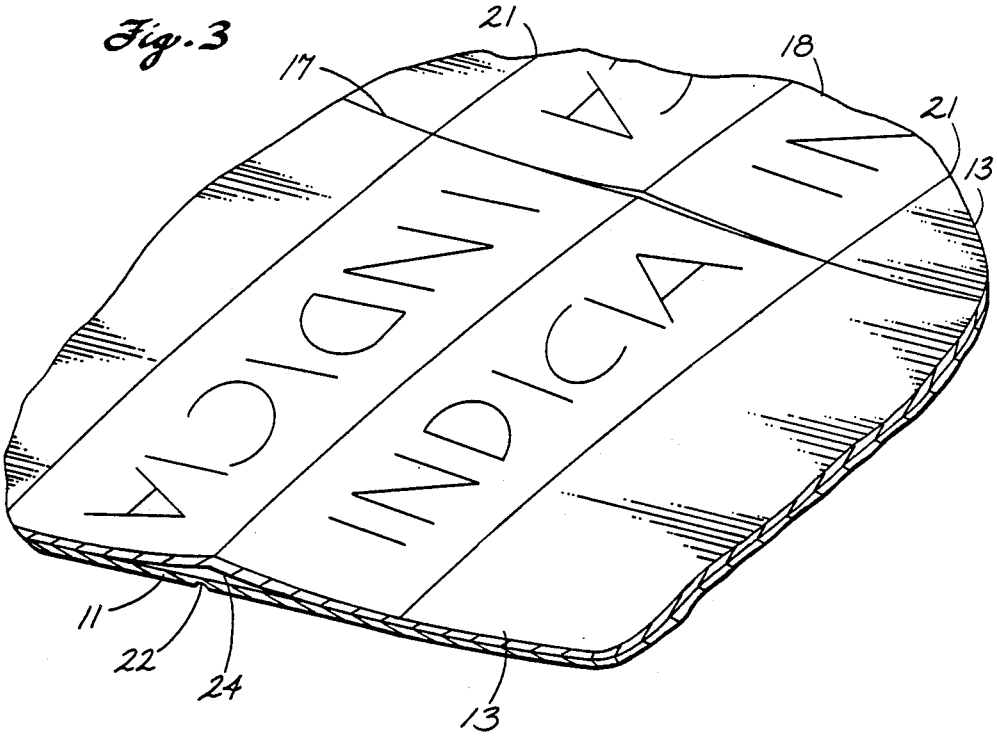
FIG. 3 is a perspective view of such index tabs indicating separation from the backing sheet.

When the sheet of index tabs is again flattened, the set of the film causes a narrow band of the film and adhesive across the center of the index tab to separate from the release coating. Slight bending of the sheet transverse to the score lines accentuates this separation as illustrated in FIG. 3 so that a finger nail or other instrument can easily peel the index tab from the backing. This obviates the difficulty often encountered in peeling labels from their backing.

When the index tab has been separated from the backing, one transparent margin is placed on the edge of a page with the contrasting edge of the band or the edge stripe aligned along the edge of the page. Since the film is transparent and the dark ink of the band or stripe can be seen through the film, the alignment of one edge of the band with the edge of the sheet from either the upper or lower face is facilitated. When properly positioned with the edge of the ink along the edge of the page, one side of the index tab is adhered to the page by the pressure sensitive adhesive.

Because of the permanent set along the center line of the index tab, it can then be folded along the mid line and the other edge of the inked band is almost automatically superimposed on the other edge of the band of ink and aligned along the edge of the page. The second margin of the tab is adhered to the page and the inked portion of the tab extending beyond the edge of the page is pinched so that the layer of pressure sensitive adhesive adheres to itself.

By using a transparent film label stock the marginal portions of the index tab overlapping the edges of the page do not obscure any underlying text. By folding the index tab along its mid line, symmetrical application to the pages is obtained. By aligning the contrasting edges of the inked band or stripes along the edge of the page, each of the index tabs applied to the pages of a book extend a uniform distance to give a neat appearance. Further, the indicia originally printed on one face of the label stock can now be read from either face of the index tab. Since the film and pressure sensitive adhesive are quite thin, no substantial bulk is added to the pages of a document, yet the tab is stiff because the extending portion has double thickness adhered to itself.

Figure 4:
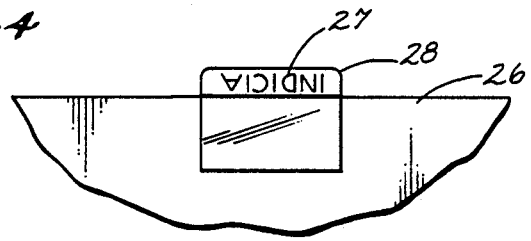
FIG. 4 is a face view of another embodiment of index tab on the edge of a page of a document.

It will be apparent that variations may be provided in practice of this invention. For example, if desired, the opposite edges of the index tab can be provided with a rounded notch opposite the locus of the score line in the backing. When such a label is folded as described, and applied to the edge of a page 26 of a document as illustrated in FIG. 4, the rectangular index tab 27 has rounded corners. In such an embodiment a small amount of the label stock adjacent the notches is left on the backing when the index tabs are removed.

Figure 5:
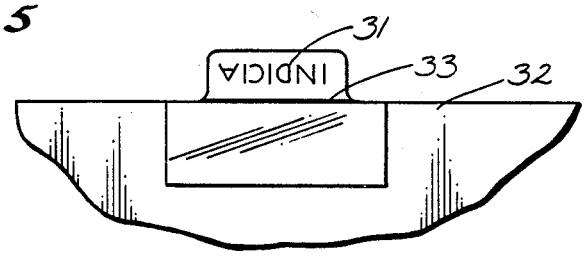
FIG. 5 is a face view of a third embodiment of deluxe index tab on the edge of a document.

Still another embodiment of generally rectangular deluxe index tab is illustrated in FIG. 5. In this embodiment each index tab 31 has a "bracket-shaped" notch on each side edge, having a width about the same as the band of ink. When such an index tab is placed on a page 32 with the edges of the band or inked stripes 33 aligned along the edge of the page, the tab has a protruding portion somewhat narrower than the transparent margin adhered to the page. This results in reinforcement of the page at the intersection of the protruding portion and the page to minimize any tendency to tear the page along the edge of the index tab.

It will be apparent that if desired rather than having a die-cut line so that the edges of adjacent rectangular tabs abut each other, spaced apart die-cuts may be made and the intervening matrix removed to leave individual index tabs as islands like die-cut labels.

Many other modifications and variations will be apparent to one skilled in the art, particularly in the indicia applied to such book index tabs. It is therefore to be understood that within the scope of the appended claims the invention may be practiced otherwise than as specifically described.

What is claimed is:

1. A sheet of book index tabs comprising:

a backing sheet having a release coating on its upper face and at least one straight score line on its lower face, the score line having a sufficiently shallow rounded bottom to facilitate folding of the backing sheet toward its lower face without breaking the backing sheet; and a plurality of book index tabs on the upper face of the backing sheet, each index tab being separated from the adjacent index tab by at least one die-cut line extending at least completely through the stock forming such index tabs, each index tab comprising:

transparent plastic film layer;

a layer of transparent pressure sensitive adhesive on the lower face of the film layer adjacent to the release coating, the adhesion between the adhesive and release coating being sufficient to permit peeling of the film layer from the backing sheet without damage to the adhesive layer; and a band of ink on the upper face of the index tab extending from edge to edge of the tab, the band of ink having a pair of straight edges parallel to such a score line on the lower face of the backing sheet and spaced equal distances from the locus of the score line so that upon creasing the backing sheet and index tab along the score line, the edges of the band of ink are substantially superimposed;

the film layer being sufficiently plastic to take a set upon creasing the backing sheet and index tab along the score line and separating from the backing sheet along the center of the band of ink upon flattening of the backing sheet after creasing.

2. A sheet of book index tabs as recited in claim 1 further comprising indicia printed on both sides of the center of the band of ink for reading from either face when the index tab is folded along the center of the band of ink.

3. A sheet of book index tabs as recited in claim 1 wherein each index tab further comprises a stripe of dark ink along each edge of the band of ink, each of the stripes being equidistant from the adjacent edge of the index tab.

4. A sheet of index tabs as recited in claim 3 wherein at least a portion of each of the stripes on such an index tab extends beyond the edge of the band of ink so as to be visible through the transparent film and adhesive.

5. A sheet of book index tabs comprising:

a paper backing sheet having a release coating on an upper face;

a plurality of generally rectangular book index tabs on the upper face of the backing sheet, the edges of adjacent index tabs abutting each other along a die-cut line, each index tab comprising:

a transparent film layer;

a transparent pressure sensitive adhesive layer between the lower face of the film layer and the release coating, the adhesive layer having sufficient tackiness for adhering securely to paper and being releasable from the release coating;

a band of flexible opaque ink extending between a pair of parallel edges of the tab, the band being symmetrically located between the other pair of edges of the tab; and a stripe of dark ink extending along each edge of the opaque band; and a straight score line having a rounded bottom indenting the lower face of the backing sheet sufficiently less than the thickness of the backing sheet that the backing sheet does not break through upon crimping of the index tabs and backing sheet along the score line toward the lower face of the backing sheet, the score line being midway between the stripes;

the film layer being sufficiently plastic to take a permanent set upon crimping along the score line toward the lower face of the backing sheet and separating the adhesive layer from the release coating along the permanent set.

6. A sheet of index tabs as recited in claim 5 wherein each stripe extends at least in part beyond the edge of the opaque ink band to be visible through the transparent film layer.

7. A sheet of book index tabs as recited in claim 5 further comprising indicia printed on both sides of the center of the band of ink for reading from either face when the index tab is folded along the center of the band of ink.

* * * * *